US009511476B2

(12) United States Patent
Shinozaki

(10) Patent No.: US 9,511,476 B2
(45) Date of Patent: Dec. 6, 2016

(54) DRESSER DISK CLEANING BRUSH, CLEANING APPARATUS, AND CLEANING METHOD

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 655 days.

(21) Appl. No.: 13/934,415

(22) Filed: Jul. 3, 2013

(65) Prior Publication Data

US 2014/0041687 A1 Feb. 13, 2014

(30) Foreign Application Priority Data

Aug. 7, 2012 (JP) ..... 2012-174863

(51) Int. Cl.

| | |
|---|---|
| ***B24B 53/017*** | (2012.01) |
| ***B08B 1/00*** | (2006.01) |
| ***A46B 11/06*** | (2006.01) |
| ***A46B 11/00*** | (2006.01) |

(52) U.S. Cl.

CPC ..... *B24B 53/017* (2013.01); *A46B 11/0006* (2013.01); *A46B 11/06* (2013.01); *B08B 1/002* (2013.01); *A46B 2200/30* (2013.01)

(58) Field of Classification Search

CPC ..... B24B 53/017; B08B 1/002; B08B 1/04; A46B 11/0006; A46B 11/063; A46B 11/066; A46B 2200/30

See application file for complete search history.

(56) References Cited

U.S. PATENT DOCUMENTS

2004/0134792 A1 7/2004 Butterfield

FOREIGN PATENT DOCUMENTS

| | | | | |
|---|---|---|---|---|
| CN | 2730553 | Y | | 10/2005 |
| CN | 202174074 | U | | 3/2012 |
| CN | 202174489 | U | | 3/2012 |
| JP | 10189513 | A | * | 7/1998 |
| JP | 10-294261 | A | | 11/1998 |
| JP | 11-129153 | A | | 5/1999 |
| JP | 2000-208163 | A | | 10/2000 |

(Continued)

OTHER PUBLICATIONS

Machine translation: KR20040070588; Han, Gyeong-Su; 2004.*
Machine translation: JP10189513; Okamoto, T.; 1998.*

*Primary Examiner* — Michael Kornakov
*Assistant Examiner* — Natasha Campbell
(74) *Attorney, Agent, or Firm* — Pearne & Gordon LLP

(57) ABSTRACT

The present invention provides a cleaning brush and a cleaning apparatus that can effectively discharge dust, removed from a dresser disk of a CMP apparatus upon cleaning the dresser disk, to the outside of the cleaning system in order to prevent the dust from being again deposited on the dresser disk. A cleaning brush includes a large number of brushes formed to protrude on its top surface, vertical through-holes and into which a nozzle for ejecting a cleaning fluid is inserted, and a recessed groove formed on a lower surface that lower ends of the through-holes and face. It is configured such that dust deposited onto the brushes upon cleaning the dresser disk is discharged to outside from the recessed groove through a gap between the surrounding of the nozzle and the inner surface of the through-holes and together with the cleaning fluid.

7 Claims, 8 Drawing Sheets

(56) References Cited

FOREIGN PATENT DOCUMENTS

| | | | | |
|---|---|---|---|---|
| JP | 2000-280163 | A | | 10/2000 |
| JP | 2001-260024 | A | | 9/2001 |
| JP | 2003-117819 | A | | 4/2003 |
| JP | 2003-188125 | A | | 7/2003 |
| JP | 2004-306234 | A | | 11/2004 |
| JP | 2007-253258 | A | | 10/2007 |
| KR | 20040070588 | A | * | 8/2004 |

* cited by examiner

DRESSER DISK CLEANING BRUSH, CLEANING APPARATUS, AND CLEANING METHOD

TECHNICAL FIELD

The present invention relates to a cleaning brush and an apparatus for cleaning a dresser disk that polishes a surface of a polishing pad of a CMP apparatus, and a cleaning method of a dresser disk using this cleaning apparatus.

BACKGROUND ART

As illustrated in FIGS. 13A and 13B, a CMP apparatus includes a polishing table 100 having a disk-like polishing plate 102 mounted on an upper end of a rotation shaft 101 of a drive motor, and a polishing pad 103, having microporous holes formed on its surface, on a top surface of the polishing plate 102. A wafer 105 that is to be polished is held on a lower surface of a wafer carrier 104 that is rotatably supported above the polishing table 100. While a slurry that is a polish is supplied from a supply device S onto the top surface of the rotating polishing pad 103 and flowed, the wafer 105 is rotated and pressed against the surface of the polishing pad 103 by the wafer carrier 104, whereby the surface of the wafer 105 is polished to be flattened.

As ancillary facilities, there are provided a dresser disk 106 that is provided at the side of the polishing table 100 for cutting and polishing the surface of the polishing pad 103 that is clogged or becomes dull due to the repeated polishing of the wafer 105, the dresser disk 106 being mounted on a tip end of a moving arm 107 with a rotating drive mechanism 108, and a cleaning apparatus 109 that removes stains, or dust such as polishing dust, polishing-pad dust, or slurry particle, deposited onto the pad contact surface of the dresser disk 106 due to the cutting and polishing process of the surface of the polishing pad 103.

As the apparatus 109 for cleaning the dresser disk 106, the one illustrated in FIG. 14 has been known, for example. Specifically, the apparatus includes a pool tank 110 formed with an inlet port 110*a* and a drain outlet 110*b* of a cleaning liquid such as pure water, and a brush 111 that is mounted on the bottom of the pool tank 110 and that is driven to rotate by an appropriate rotating drive unit. The dresser disk 106 is dipped into the cleaning liquid filled in the pool tank 110, and the pad contact surface of the dresser disk is pressed against the rotating brush 111, whereby the dust deposited on the pad contact surface is removed in the pool tank 110 (see, for example, Patent References 1 and 2). Numeral 112 denotes a bubble generating unit.

As a brush structure in which a brush is pressed against a surface to be polished or a surface to be cleaned for polishing or cleaning, there has been known the one provided with a fluid supply port in a plane on which a brush is provided to protrude, wherein a polishing solution or cleaning liquid is ejected from the fluid supply port in order to make a polishing process or cleaning process (see, for example, Patent References 2, 3, 4, and 5).

CITATION LIST

Patent Reference

Patent Reference 1: Japanese Patent Application Laid-Open No. H11-129153

Patent Reference 2: Japanese Patent Application Laid-Open No. 2001-260024

Patent Reference 3: Japanese Patent Application Laid-Open No. 2003-188125

Patent Reference 4: Japanese Patent Application Laid-Open No. 2003-117819

Patent Reference 5: Japanese Patent Application Laid-Open No. H10-294261

SUMMARY OF THE INVENTION

Solution to Problem

In the conventional cleaning apparatus 109 described above, it is inevitable that some dust removed from the pad contact surface of the dresser disk 106 stays in the pool tank 110, even if the cleaning liquid is circulated in the pool tank 110, or even if air bubbles are generated in the cleaning liquid. Heavy dust sinks into the pool tank 110, and is deposited onto the bottom or in the brush 111, while light dust floats in the cleaning liquid or on the surface of liquid, and is not completely discharged to the outside of the pool tank 110. Therefore, the conventional cleaning apparatus entails a problem that, when the dresser disk 106 is pulled from the pool tank 110, the stayed dust is easy to be again deposited onto the dresser disk 106.

When the known brush structure provided with the fluid supply port is used as the cleaning unit for the dresser disk 106, instead of the pool tank 110, dust removed from the dresser disk 106 is easy to be adhered and deposited between the brush and the brush or between the brush and the fluid supply port due to pressing the brush against the dresser disk 106. The deposited dust might be again deposited onto the dresser disk 106 due to the sliding movement of the brush, or might inhibit the supply of the cleaning liquid.

Since neither of the cleaning units has an effective unit for discharging the dust removed from the dresser disk 106 during the cleaning process to the outside of a cleaning system in which the dresser disk 106 and the cleaning unit are opposite to each other, the cleaning efficiency cannot be improved, and at present, an operation in which a maintenance period of cleaning the dresser disk 106 is set to be short has to be performed, which cannot bring a satisfactory cleaning effect.

The present invention is accomplished in view of the problems of the background art, and aims to provide a cleaning brush and a cleaning apparatus that can effectively discharge dust, removed from the dresser disk, to the outside of the cleaning system in order to prevent the dust from being again deposited on the dresser disk during the cleaning process of the dresser disk in a CMP apparatus, and to enhance a cleaning efficiency of the dresser disk by using the cleaning brush and the cleaning apparatus.

Solution to Problem

In order to solve the foregoing problem, the present invention proposes a dresser disk cleaning brush that is fixed to an arm portion of a body of a cleaning apparatus which a nozzle for ejecting a cleaning fluid is formed to protrude on the top surface to form a dresser disk cleaning apparatus, comprising: a large number of brushes formed on the top surface; a vertical through-hole into which the nozzle is inserted and formed inside thereof; a recessed groove formed on a lower surface that the lower end of the through-hole faces; and having a configuration, wherein dust that is deposited onto the brush upon cleaning a dresser disk with the cleaning fluid ejected from the nozzle is discharged to outside, together with the cleaning fluid, from the recessed groove through a gap between the surrounding of the nozzle and the inner surface of the through-hole.

The cleaning brush thus configured is fixed to the arm portion of the body of the cleaning apparatus which is arranged at the side of a polishing table of a CMP apparatus and the nozzle for ejecting the cleaning fluid is formed to protrude on its top surface, thereby forming the apparatus for cleaning the dresser disk.

The dresser disk is cleaned by using this cleaning apparatus in such a manner that the dresser disk is held and rotated with a pad contact surface of the dresser disk being in contact with a cleaning brush, while ejecting a cleaning fluid from a nozzle, in order to scrub the pad contact surface; and then, the dresser disk is held and rotated with the dresser disk being arranged above the cleaning brush, while ejecting the cleaning fluid from the nozzle, in order to rinse the pad contact surface.

According to this, in the scrubbing process described above, the dust removed from the pad contact surface of the dresser disk due to the relative sliding movement of the brush falls down onto the top surface of the cleaning brush together with the cleaning fluid, flows down in the through-hole, into which the nozzle is inserted, through the gap formed between the inner surface of the through-hole and the surrounding of the nozzle, and is discharged to the outside of the cleaning brush from the recessed groove communicating with the lower end of the through-hole.

Since the gap, through which the dust removed from the dresser disk falls down together with the cleaning fluid, can be secured between the inner surface of the through-hole into which the nozzle is inserted and the surrounding of the nozzle, the dust generated in the scrubbing process can be discharged to the outside of the cleaning brush together with the cleaning fluid. Therefore, this structure can prevent the dust from being adhered and deposited between the brush and the brush or on the upper end of the through-hole located above the nozzle. Accordingly, this structure can effectively prevent the dust from being again deposited onto the dresser disk, resulting in that fresh cleaning fluid can always be ejected from the nozzle.

Since the dresser disk is rinsed by the ejected cleaning fluid after the scrubbing process, the dust that has not been removed in the scrubbing process can surely be removed.

The cleaning brush having the configuration described above can be formed by two parts, which are a brush body having a large number of brushes formed to protrude on its top surface, and the vertical through-hole that is formed inside and into which the nozzle is inserted; and a base having a vertical through-hole into which the nozzle is inserted, and the recessed groove formed on a lower surface that the lower end of the through-hole faces. The cleaning brush is integrally fixed to the arm portion having the nozzle formed to protrude on its top surface with the brush body being superimposed on the base. Thus, the cleaning apparatus is configured.

Since the cleaning brush is formed by two parts that are the brush body and the base, both parts are exploded during the maintenance operation, and the channel through which the dust is discharged can easily be cleaned. When the brush becomes worn, only the brush body is exchanged, whereby the cost of the cleaning brush, which is a consumable supply, can be reduced.

In the cleaning brush having the configuration described above, it is preferable that the through-hole into which the nozzle is inserted is provided near the center, and the surrounding of the top end of the through-hole is enclosed by a brush group that is arranged to protrude on the top surface of the cleaning brush in a houndstooth manner as viewed in a plane.

As described above, the brushes are arranged in plural rows so as to enclose the through-hole into which the nozzle is inserted, and the brushes are arranged in a houndstooth manner in which the adjacent brushes are shifted from each other. With this structure, when the cleaning fluid is ejected with the pad contact surface of the dresser disk being in contact with the cleaning brush in the scrubbing process, the pressure enclosed by the brush group is increased than the pressure on the surrounding. This promotes the inflow of the dust removed from the pad contact surface of the dresser disk and the cleaning fluid splashing from the pad contact surface into the gap on the inner surface of the through-hole into which the nozzle is inserted, thereby being capable of enhancing the effect of discharging the dust to the outside of the cleaning brush.

In the cleaning brush having the configuration described above, it is preferable that the inner diameter of the through-hole is set to be larger than the outer diameter of the nozzle in order to form the gap, through which the dust can pass, between the surrounding of the nozzle and the inner surface of the through-hole when the nozzle is inserted into the through-hole, and the gap of about 1 mm to 5 mm is secured around the nozzle.

The cleaning brush may be provided with a dust discharge channel, separate from the through-hole into which the nozzle is inserted, wherein the dust discharge channel is a channel through which the dust can pass together with the cleaning fluid, and has one end open to the top surface of the cleaning brush, and the other end communicating with the recessed groove.

BRIEF DESCRIPTION OF THE DRAWINGS

FIGS. 13A and 13B are a view for describing a configuration of one example of a CMP apparatus, wherein FIG. 13A is a plan view, and FIG. 13B is a side view.

DESCRIPTION OF EMBODIMENTS

Preferable embodiments of the present invention will be described with reference to the drawings.

Figure 1:
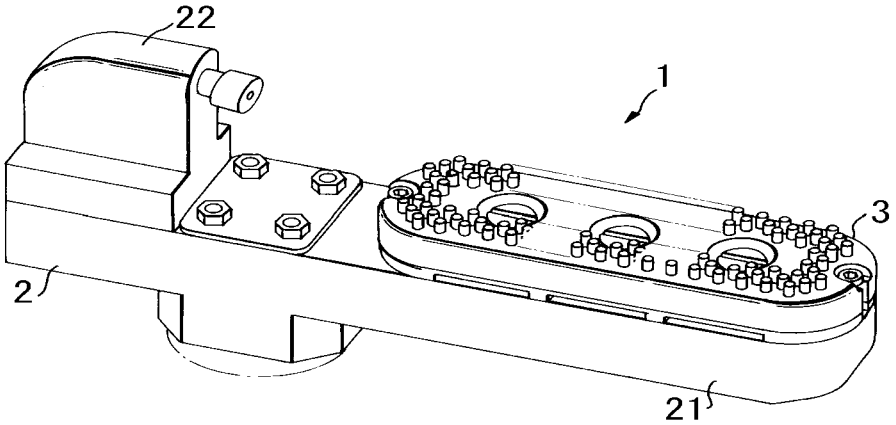
FIG. 1 is a view illustrating an appearance of a cleaning apparatus according to one embodiment of the present invention.

FIG. 1 illustrates a dresser-disk cleaning apparatus according to one embodiment of the present invention. The cleaning apparatus 1 includes an apparatus body 2 and a cleaning brush 3, wherein the cleaning brush 3 is integrally fixed to an arm portion 21 of the apparatus body 2 having a nozzle 24 for ejecting a cleaning fluid formed to protrude on its top surface. The cleaning apparatus 1 is arranged at the side of a polishing table of a CMP apparatus which is not illustrated.

Figure 9:
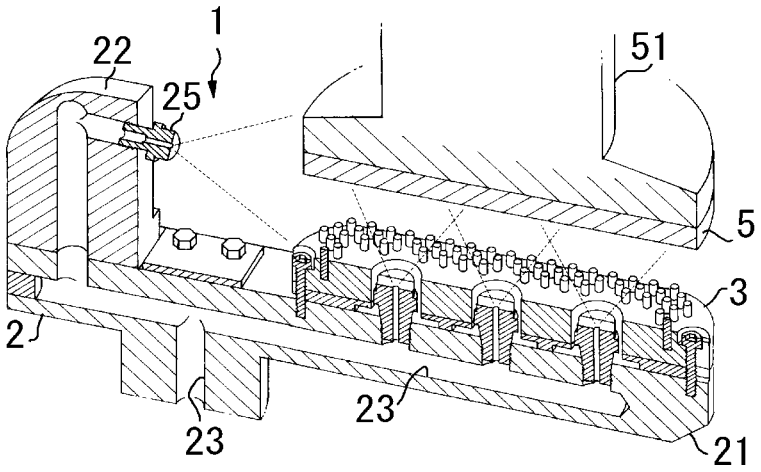
FIG. 9 is a perspective sectional view illustrating the state in which a dresser disk is rinsed by the cleaning apparatus in FIG. 1.

A protruding portion 22 protrudes upward from one end of the horizontal arm portion 21 of the apparatus body 2, and a supply channel 23 for a cleaning fluid is formed in the apparatus body as illustrated in FIG. 9 described later, whereby the cleaning fluid can be ejected from three nozzles 24, which are mounted to protrude from the top surface of the arm portion 21 such that the upper half part protrudes from the arm portion 21, and the lower end communicates with the supply channel 23, and a nozzle 25 that is mounted to an upper end of the protruding portion 22 so as to communicate with the supply channel 23. The cleaning fluid can be supplied by driving a cleaning fluid supply mechanism which is not illustrated.

Figure 2:
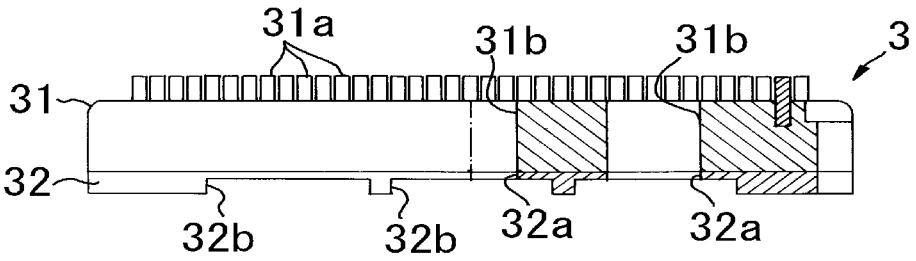
FIG. 2 is a side view illustrating a cross-section of a half side of the cleaning brush illustrated in FIG. 1.

The cleaning brush 3 is made of a material having elasticity, such as synthetic resin. As illustrated in FIGS. 2 and 3, the cleaning brush 3 has a horizontally long top surface having almost an elliptic shape as viewed in a plane, and a large number of brushes 31*a* formed by bundling a set of thin nylon hairs are implanted integrally on the top surface.

More specifically, the cleaning brush 3 includes two parts, which are a brush body 31 having a large number of brushes 31*a* protruding on its top surface and having formed therein three through-holes 31*b* into which the respective nozzles 24 are inserted, and a base 32 having formed therein three through-holes 32*a*, into which the respective nozzles 24 are inserted similarly, the base supporting the brush body 31 placed on the top surface of the base.

Recessed grooves 32*b* that are wider than the respective through-holes 32*a* and extend to both side faces in the widthwise direction of the base 32 are formed on the portion of the bottom surface of the base 32 that the lower end of each of the through-holes 32*a* faces.

Notches 31*c* and 32*c* having a U-shaped cross-section and with which a fixing member 4 such as a fastening screw is engaged are formed respectively on both ends of the brush body 31 and the base 32 in the longitudinal direction.

Figure 3A:
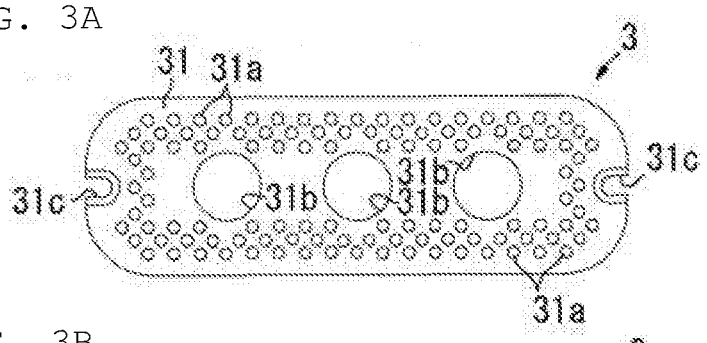
FIG. 3A is a top view and FIG. 3B is a bottom view of the cleaning brush illustrated in FIG. 1.
Figure 3B:
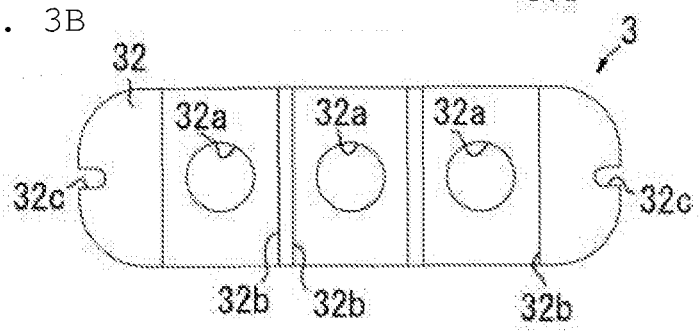

As illustrated in FIGS. 3A and 3B, the through-holes 31*b* on the brush body 31 and the through-holes 32*a* on the base 32 are formed to correspond to the positions where the nozzles 24 on the arm portion 21 of the apparatus body 2 protrude, and are formed to have the same inner diameter on the portion near the center of the brush body 31 and the base 32 at equal spaces. A large number of brushes 31*a* protruding on the top surface of the brush body 31 is arranged to enclose the surrounding of the upper end of each through-hole 31*b* in plural rows, and are arranged in houndstooth manner in which the adjacent brushes are shifted from each other.

Figure 4:
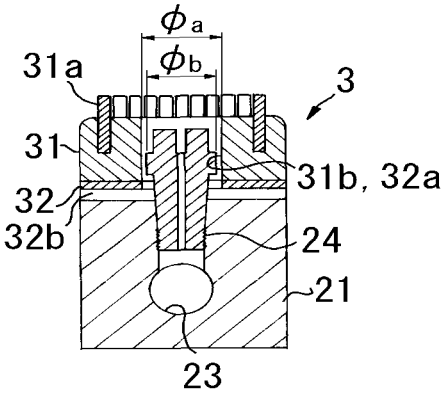
FIG. 4 is an enlarged sectional view of an arm portion, to which the cleaning brush is mounted, of the cleaning apparatus illustrated in FIG. 1.

As illustrated in FIG. 4, the through-hole 31*b* on the brush body 31 and the through-hole 32*a* on the base 32 are formed to have the inner diameter ϕa larger than the outer diameter ϕ of the nozzle 24. In a state in which the brush body 31 and the base 32 are superimposed, and mounted on the top surface of the arm portion 21, and nozzle 24 is inserted into the through-holes 31*b* and 32*a*, a gap of about 1 mm to 5 mm is secured between the surrounding of the nozzle 24 and the inner surface of the through-holes 31*b* and 32*a*. This gap communicates with the recessed groove 32*b* formed on the lower surface of the base 32.

Figure 5:
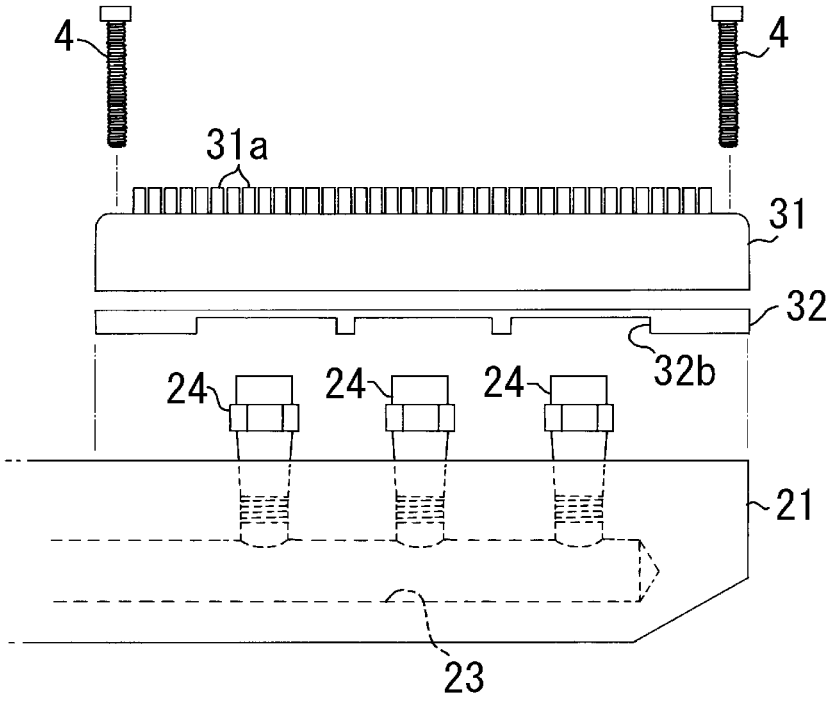
FIG. 5 is a view illustrating the arm portion of the cleaning apparatus and parts of the cleaning brush that are exploded.
Figure 6:
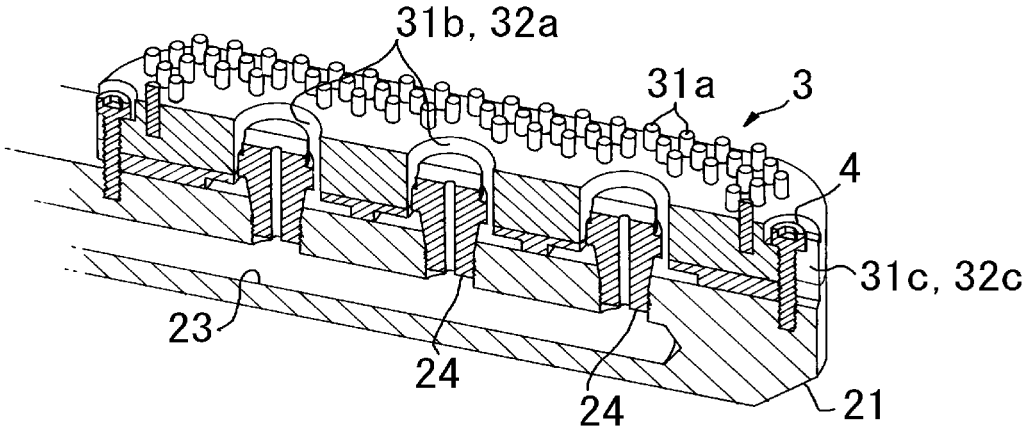
FIG. 6 is a sectional view illustrating an essential part of the portion of the cleaning apparatus in FIG. 1 to which the cleaning brush is mounted.

As illustrated in FIGS. 5 and 6, the cleaning brush 3 is configured such that the nozzle 24 is inserted into the through-holes 31*b* and 32*a*, and with this state, the base 32 and the brush body 31 are vertically superimposed and mounted on the top surface of the arm portion 21 of the apparatus body 2. The fixing member 4 is engaged with each of the notches 31*c* and 32*c* formed on both ends of the brush body and the base, and the shaft of the fixing member 4 is fastened and fixed to the arm portion 21. The cleaning brush 3 is thus fixed, and hence, the cleaning apparatus 1 is completed.

Figure 7:
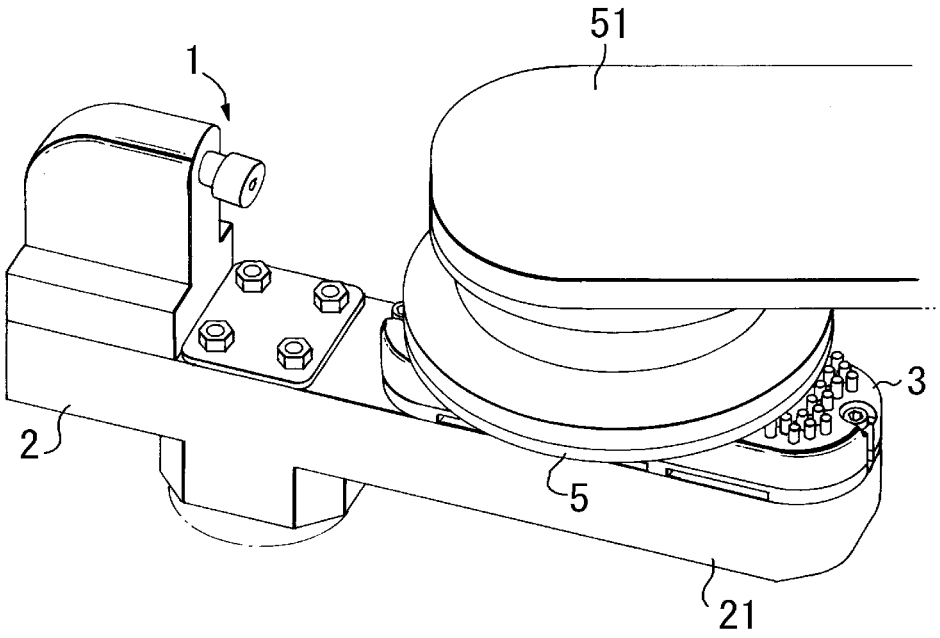
FIG. 7 is an appearance view illustrating the state in which a dresser disk is scrubbed by the cleaning apparatus in FIG. 1.
Figure 8:
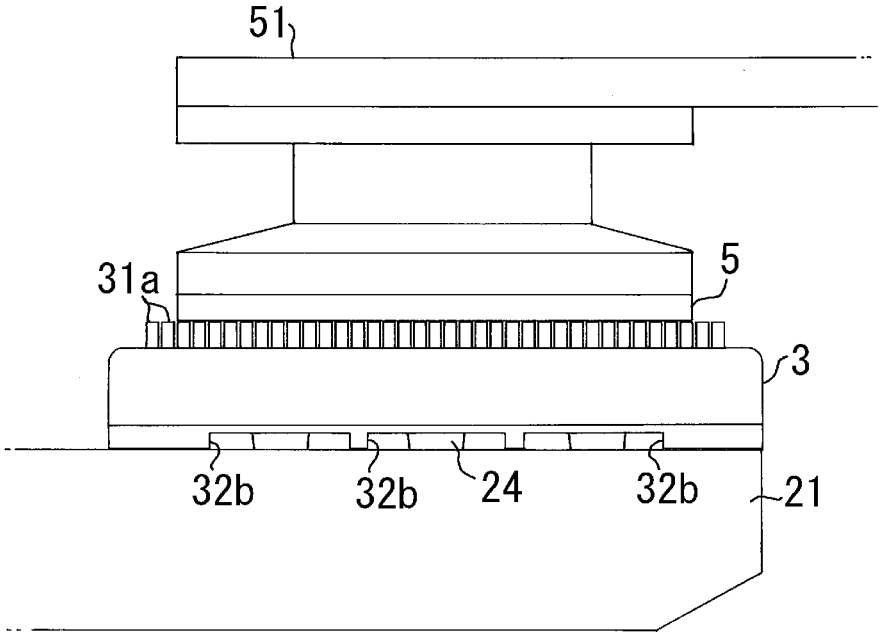
FIG. 8 is a side view of an essential part illustrated in FIG. 7.

In order to clean the dresser disk by using the cleaning apparatus 1 thus configured according to the present embodiment, the pad contact surface of the dresser disk 5 supported to the lower part of the moving arm 51 is brought into contact with the brushes 31*a* on the cleaning brush 3, and with this state, the dresser disk 5 is rotated, while the cleaning fluid is ejected from the nozzle 24 as illustrated in FIGS. 7 and 8. Thus, the pad contact surface is scrubbed.

In this case, the dust deposited onto the pad contact surface of the dresser disk 5 is scraped by the relative sliding movement of the brushes 31*a*. The dust removed from the pad contact surface descends onto the top surface of the cleaning brush 3 together with the cleaning fluid, flows down in the through-holes 31*b* and 32*a*, into which the nozzle 24 is inserted, through the gap formed between the inner surface of the through-holes 31*b* and 32*a* and the surrounding of the nozzle 24, and is discharged to the outside of the cleaning brush 3 from the recessed groove 32*b* communicating with the lower end of the through-hole 32*a*.

This structure can prevent the dust removed from the pad contact surface from being adhered and deposited between the brush 31*a* and the brush 31*a* or on the upper end of the through-hole 31*b* located above the nozzle 24. Thus, this structure can effectively prevent the dust from again being deposited onto the dresser disk 5, resulting in that fresh cleaning fluid can always be ejected from the nozzle 24.

Then, as illustrated in FIG. 9, the dresser disk 5 is arranged above the cleaning brush 3 with an appropriate space, and with this state, the dresser disk 5 rotates, while ejecting the cleaning fluid from the nozzles 24 arranged in the top surface of the cleaning brush 3 and the nozzle 25 mounted on the upper part of the protruding portion 22 of the apparatus body 2, in order to rinse the pad contact surface. Thus, the cleaning of the dresser disk 5 is completed.

Since the dresser disk 5 is rinsed by the ejected cleaning fluid after it is scrubbed as described above, the dust that cannot be removed during the scrubbing operation can surely be washed away.

Figure 10:
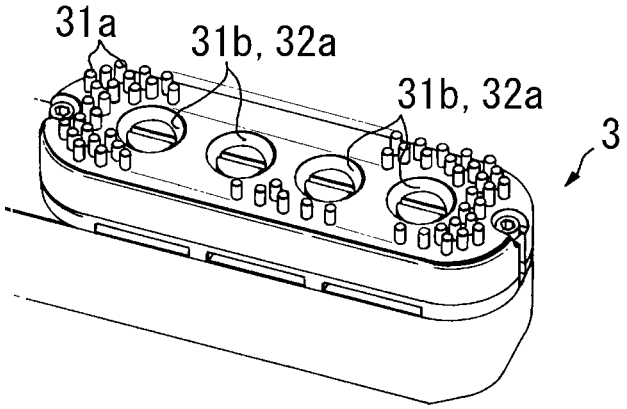
FIG. 10 is an appearance view of a cleaning brush according to another embodiment.

The through-holes 31*b* and 32*a*, which are formed on the cleaning brush 3, and into which the nozzles 24 are inserted, are formed according to the number of the nozzles 24 protruding on the arm portion 21 of the apparatus body 2. For example, when four nozzles 24 are provided to protrude from the arm portion 21, four through-holes 31*b* and 32*a* into which the corresponding nozzle 24 is inserted are formed according to four nozzles as illustrated in FIG. 10.

Figure 11:
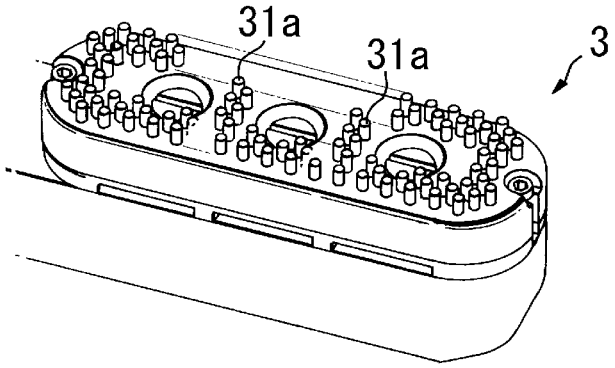
FIG. 11 is an appearance view of a cleaning brush according to still another embodiment.

As illustrated in FIG. 11, the brushes 31*a* may be formed to protrude between the through-holes 31*b* and 31*b* on the top surface of the cleaning brush 3.

Figure 12:
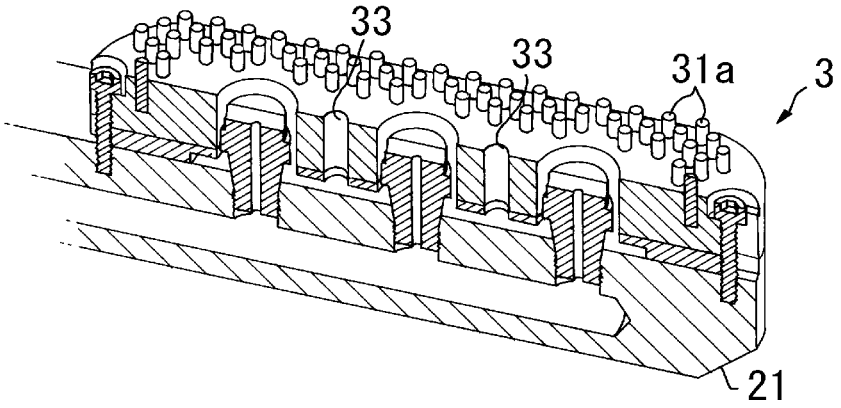
FIG. 12 is a sectional view illustrating a cleaning brush mounted to an arm portion of a cleaning apparatus according to still another embodiment.
Figure 13A:
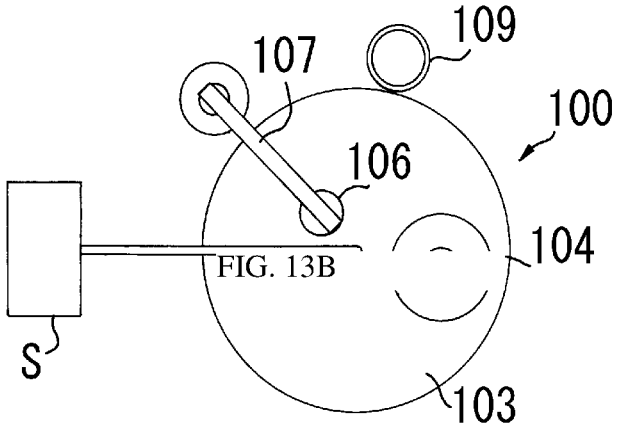
FIG. 13A PRIOR ART
Figure 13B:
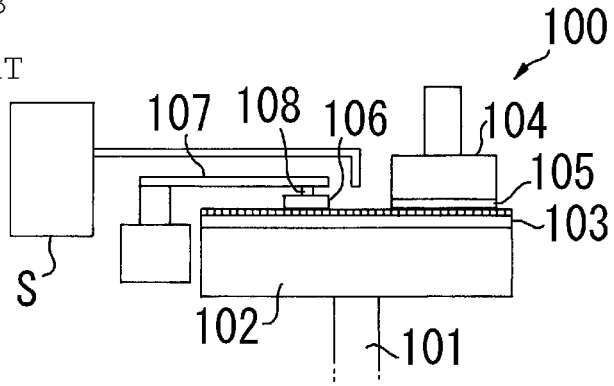
FIG. 13B PRIOR ART
Figure 14:
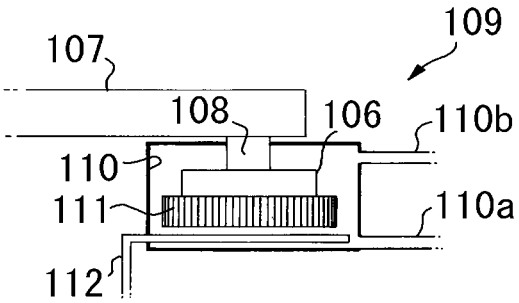
FIG.14 PRIOR ART
FIG. 14 is a view illustrating one example of a configuration of a conventional cleaning apparatus of a dresser disk.

As illustrated in FIG. 12, a dust discharge channel 33 that has a size by which the dust can pass together with the cleaning fluid, has one end open to the top surface of the cleaning brush 3, and has the other end communicating with the recessed groove 32*b* may be formed, separate from the through-holes 31*b* and 32*a* into which the nozzles 24 are inserted, and the dust may be discharged to outside through the dust discharge channel 33.

The illustrated cleaning brush 3, the apparatus body 2, and the cleaning apparatus 1 are only illustrative of the embodiment of the present invention, and the present invention is not limited thereto. The present invention can be made by another appropriate form. The cleaning brush 3 may be formed such that the brush body 31 and the base 32 are integrally formed.

REFERENCE SIGNS LIST

1 CLEANING APPARATUS
2 APPARATUS BODY
21 ARM PORTION
22 PROTRUDING PORTION
23 FLUID SUPPLY CHANNEL
24, 25 NOZZLE
3 CLEANING BRUSH
31 BRUSH BODY
32 BASE
31*a* BRUSH
31*b*, 32*a* THROUGH-HOLE
32*b* RECESSED GROOVE
31*c*, 32*c* NOTCH
4 FIXING MEMBER
5 DRESSER DISK

The invention claimed is:

1. A dresser disk cleaning brush for cleaning a dresser disk, the cleaning brush comprising:

a brush body having a vertical through-hole into which a first nozzle for ejecting a cleaning fluid and a dust discharge channel for discharging dust are provided;

a recessed groove formed on a lower surface of the cleaning brush that the lower end of the through-hole faces; and a plurality of brushes mounted on a top surface of the brush body, wherein the dust discharge channel has one end open to the top surface of the brush body, and the other end communicating with the recessed groove.

2. The dresser disk cleaning brush according to claim 1, further comprising:

a base having a vertical through-hole into which the first nozzle is inserted, and the recessed groove of the cleaning brush being formed on a lower surface of the base.

3. The dresser disk cleaning brush according to claim 1, wherein the through-hole into which the first nozzle is inserted is provided near the center, and the surrounding of the top end of the through-hole is enclosed by a brush group that is arranged to protrude on the top surface of the cleaning brush in a houndstooth manner as viewed in a plane.

4. A dresser disk cleaning brush for cleaning a dresser disk, the cleaning brush comprising:

a brush body having a vertical through-hole into which a nozzle is inserted and formed inside thereof;

a recessed groove formed on a lower surface of the cleaning brush that the lower end of the through-hole faces; and a plurality of brushes formed on a top surface of the brush body;

having a configuration, wherein dust that is deposited onto the cleaning brush upon cleaning the dresser disk with a cleaning fluid ejected from the nozzle is discharged to outside, together with the cleaning fluid, from the recessed groove through a gap between the surrounding of the nozzle and the inner surface of the through-hole, and wherein a dust discharge channel is provided, separate from the through-hole into which the nozzle is inserted, and the dust discharge channel has one end open to the top surface of the brush body, and the other end communicating with the recessed groove.

5. A dresser-disk cleaning apparatus having a configuration, wherein the cleaning brush according to claim 1 is fixed to an arm portion of a body of the cleaning apparatus.

6. A method of cleaning a dresser disk by using the cleaning apparatus according to claim 5, the method comprising:

a step in which the dresser disk is held and rotated with a pad contact surface of the dresser disk being in contact with the cleaning brush, while ejecting the cleaning fluid from the first nozzle of the cleaning brush, in order to scrub the pad contact surface; and a step in which the dresser disk is held and rotated with the dresser disk being arranged spaced above the cleaning brush, while ejecting the cleaning fluid from the first nozzle, in order to rinse the pad contact surface.

7. The dresser-disk cleaning apparatus according to claim 5, wherein the arm portion has a second nozzle that ejects a cleaning fluid and that is provided to protrude on the top surface of the arm portion.

* * * * *